United States Patent [19]

Martell

[11] Patent Number: 4,767,359

[45] Date of Patent: Aug. 30, 1988

[54] SAFETY ELECTRICAL WALL OUTLET

[76] Inventor: Gregg Martell, 8644 Cavel St., Downey, Calif. 90242

[21] Appl. No.: 61,324

[22] Filed: Jun. 12, 1987

Related U.S. Application Data

[62] Division of Ser. No. 889,696, Jul. 28, 1986, abandoned.

[51] Int. Cl.[4] ..... H01R 19/44

[52] U.S. Cl. ..... 439/535; 439/620; 200/51 R

[58] Field of Search ..... 439/535, 536, 538, 650, 439/654, 682, 686, 690, 106, 107, 620; 200/51 R

[56] References Cited

U.S. PATENT DOCUMENTS

| | | | |
|---|---|---|---|
| 1,983,449 | 12/1934 | Frank | 200/51 R |
| 3,054,994 | 9/1962 | Haram | 340/326 |
| 3,163,728 | 12/1964 | Martin | 200/51 R |
| 3,324,260 | 6/1967 | Schumacher | 200/51 R |
| 3,922,586 | 11/1975 | Buxton et al. | 200/51 R |
| 4,079,344 | 3/1978 | Lauben et al. | 335/2 |

FOREIGN PATENT DOCUMENTS

| | | | |
|---|---|---|---|
| 2757967 | 7/1979 | Fed. Rep. of Germany | 439/620 |

*Primary Examiner*—Gil Weidenfeld
*Assistant Examiner*—Gary F. Paumen
*Attorney, Agent, or Firm*—Singer & Singer

[57] ABSTRACT

A six plug safety receptacle is described that is designed to replace the standard double plug receptacle usually found in most homes and businesses. In one embodiment the receptacle is adapted to plug into a standard three prong receptacle. The face plate is usually removed and the receptacle is locked in place using the same opening that secures the face plate. In the second embodiment the outlet contains a terminal block having three terminals adapted to be connected to the house wires located in the receptacle box. In this case the standard double plug receptacle is eliminated and the wall receptacle is secured to the box by the same two screw holes in the box used to secure the former receptacle. A circuit breaker and an external switch control for resetting the circuit breaker is located on the wall receptacle.

4 Claims, 2 Drawing Sheets

SAFETY ELECTRICAL WALL OUTLET

This is a divisional of Ser. No. 889,696, filed July 28, 1986 and now abandoned.

This invention relates to an improved electrical wall receptacle and more particularly to a multi-plug receptacle having a built-in circuit breaker and adapted to be locked in position either in a standard double wall receptacle or in a standard double receptacle box.

The present invention is concerned not only with safety and appearance but also with reducing the cost to the home owner by making a better product available to him for each receptacle in his house and without duplicating the problem of having additional portable receptacles with built-in circuit breakers.

In the art as practiced today thereof is available to the home owner or hobbyist many different receptacle cords or multi-user receptacle boxes having resettable built-in circuit breakers. These prior art devices usually have a short cord approximately 12 inches long having a single three prong plug adapted to be inserted in the users wall receptacle. The circuit breaker prevents overloading the circuit and the user usually has up to six additional outlets for his use all protected by the circuit breaker.

The present invention is concerned with making every double receptacle a safety receptacle protected by an individual circuit breaker and at the same time provide at least six additional receptacles for the users enjoyment. The additional outlets are located on the wall radially and do not project in the room thereby eliminating a potential hazard from loose projecting wires.

The basic invention comprises an electrical wall receptacle of the type having a plurality of electrical receptacles and a built-in circuit breaker protection device adapted to be inserted into a standard double prong into a receptacle or receptacle box and locked in place.

There are described two embodiments of the same invention. The first embodiment comprises a three prong-connector that is adapted to be inserted into a standard double wall receptacle and locked in place with either the face plate in place or with face plate removed. The wall receptacle comprises a sealed rectangular box having a substantially flat front surface and rear surface and at least six electrical receptacles on the periphery separating the front face from the rear face.

The front surface contains a circuit breaker reset switch adapted to control the built-in circuit breaker. A pair of three prong connectors located on the rear surface are adapted to be inserted into a standard double plug receptacle located in the users home or dwelling. A centrally located single locking screw extending through the front surface and the rear surface is used to engage the single screw opening located in the standard double plug receptacle.

In the preferred embodiment the face plate is removed in order to reduce the total distance that the wall receptacle extends from the users wall. Leaving the face plate in place increases the projection by an additional $\frac{3}{8}$ of an inch. The locking screw uses the same hole used by the face plate and in this way the wall receptacle is locked to the double receptacle A feature common to both embodiment is to locate the six receptacles on the periphery of the connector with the ground socket located closest to the front surface. In this manner the cord used by the home owner is located closes to the wall and the projection of the users cord or cords in to the room is minimized.

The second embodiment is very similar to the first embodiment with the following changes. The pair of three prong connectors located on the rear face is eliminated and replaced by three terminals located on extension of the rear surface and adapted to be inserted into an empty electrical terminal box. The second embodiment replaces the standard double receptacle. Two screws extending through the front surface and the rear surface engage the screw openings located on the empty receptacle box and in this way the wall receptacle is locked in place.

It is envisioned that the first embodiment will be used as an add on to existing structures while the second embodiment will be used by builders as replacements for the standard double socket receptacles. In any event the second embodiment can be used by present owners to up-date existing double socket receptacles and thereby obtain circuit breaker protection for every double outlet box.

Further objects and advantages will be made more apparent as the description progresses. Reference is now made to the accompanying drawings wherein.

Figure 1:
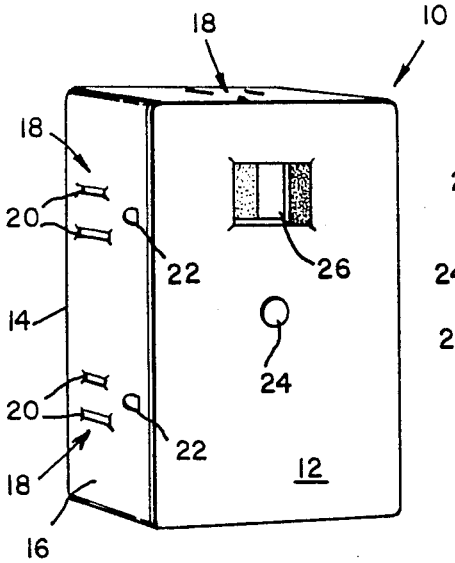
FIG. 1 is a perspective illustration of the first embodiment of the present invention.
Figure 2:
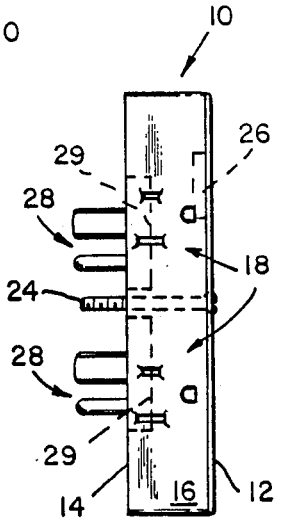
FIG. 2 is a side view of FIG. 1 illustrating the preferred placement of the receptacles on the periphery of the connector.

Referring now to FIGS. 1 and 2, there is shown a first embodiment of a safety electrical wall plug connector 10 constructed according to the present invention. The connector 10 consists of a sealed rectangular container having a front surface 12 and a rear surface 14. Located on the periphery surface 16 between the front surface 12 and the rear surface 14 are at least six receptacles 18 two on each side with one on the top and one on the bottom. Each of the receptacles 18 consists of two power sockets 20 and a ground socket 22.

In the preferred embodiment the ground socket 22 is located on the periphery 16 and placed closest to the front surface 12. In this manner any plugs inserted into the receptacles 18 will cause the live wires to be near the wall portion abutting the rear surface 14.

The unobvious advantage of having the receptacles on the periphery is to keep all wires and plugs as close to the supporting wall as possible thereby preventing wires from extending into the room. In the same manner having the ground socket 22 closest to the front surface also keeps the plug and attending wires closest to the supporting wall.

Located centrally on the front surface 12 and extending through the rear surface 14 is a supporting screw 24.

Screw 24 is adapted to extend through the connector 10 and be inserted into any standard double plug receptacle box to thereby lock the connector to the receptacle box. In the usual case the face plate will be removed however it is possible to leave the face plate in position when locking the connector 10 in place.

Figure 8:
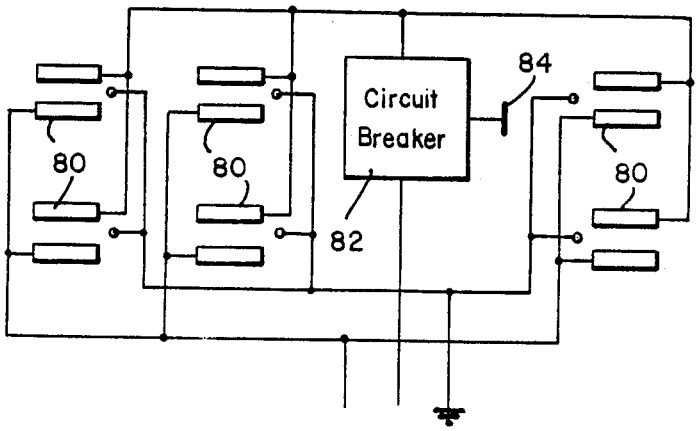

The connector is sealed and contains the circuit illustrated in FIG. 8. The circuit breaker is resettable and the switch 26 for resetting the circuit breaker is located on the front surface. In the preferred embodiment the switch 26 is a rocker switch for ease of handling.

Extending from the rear surface 14 is a pair of three prong connectors 28 adapted to fit into a standard double plug receptacle.

In order to reduce the projection of the connector 10 into the room the face plate is remove and the connector is inserted. Cut-outs 29 located in the rear surface 14 allow the rear surface to be insert into the receptacle box and additional ⅜ of an inch.

Figure 3:
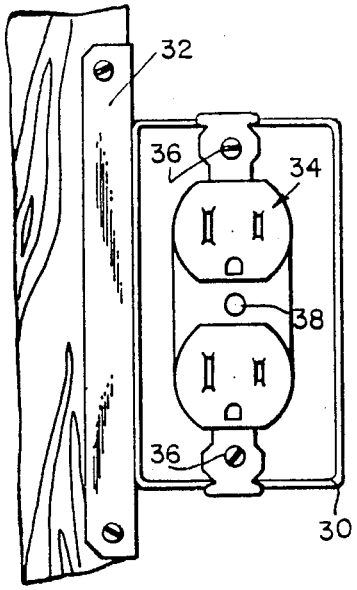
Fig. 3. PRIOR ART
FIG. 3 is a front view of a standard double receptacle secured in an receptacle box with the face plate removed.

Referring now to FIG. 3 there is shown a standard outlet box 30 connected to building studs 32 and containing a standard double plug receptacle 34. A pair of screws 36 attaches the double plug receptacle 34 to the outlet box 30 in the conventional manner. A screw hole 38 located centrally in the double plug receptacle 34 accepts an external screw for holding a face plate in position.

The connector 10 illustrated in FIGS. 1 and 2 is inserted into the double plug receptacle 34 with the pair of three prong connectors 28 inserted into the receptacles located in the outlet. The screw 40 illustrated in FIG. 2 extends through the front surface 12 and extends through the rear surface 14 into the screw hole 30 located in the receptacle 34 for securing the connector 10 to the double plug receptacle.

In the usual manner the conventional face plate will be removed before inserting the connector 10 into the receptacle receptacle 34 however the face plate may be left in position with only the holding screw removed before inserting the connector with the elongated holding screw 40. Leaving the face plate in place will cause the connector 10 to be extended into the room approximately ⅜ of an inch. This projection can be eliminated by simply removing the old face plate before inserting the connector 10.

Figure 4:
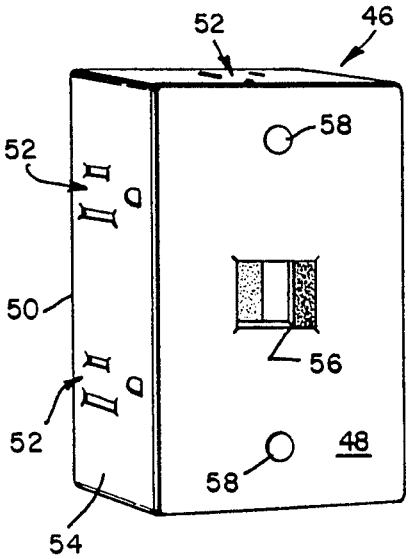
FIG. 4 is a perspective illustration of the second embodiment of the present invention.

Referring now to FIG. 4 is the second embodiment of the invention illustrating connector 46 which is adapted for permanent installation.

Connector 46 is constructed of the same general dimensions as connector 10 and contains a front surface 48 and a rear surface 50. Located between the front surface 48 and the rear surface 50 are at least six receptacles 52 on the periphery surface 54. The location of the receptacles 52 are the same as described in connection with terminals 20 and 22 in FIGS. 1 and 2.

Located on the front surface is a centrally located switch 56 used to reset the internal circuit breaker as illustrated in FIG. 8. A pair of elongated holding screws 58 extend through the front surface 48 and out the rear surface 50 and are adapted to engage screw holes located in a standard receptacle box thereby holding the connector 46 locked in place.

Figure 5:
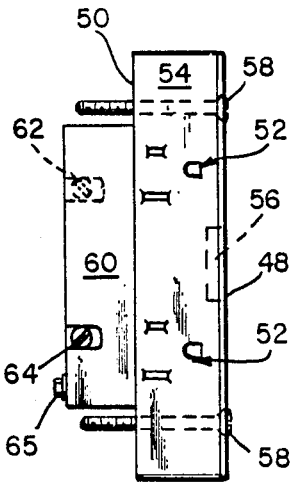
FIG. 5 is a side view of FIG. 4.

Referring now to FIG. 5 is a side view of the connector 46 illustrated in FIG. 4. Attached to the rear surface 50 is a terminal block 60 having terminals 62, 64 and 65 attached on opposite sides of the block. Terminals 62, 64 and 65 are adpated to be connected to the house wiring usually located in the receptacle box thereby making a permanent installation for the connector 46.

Figure 6:
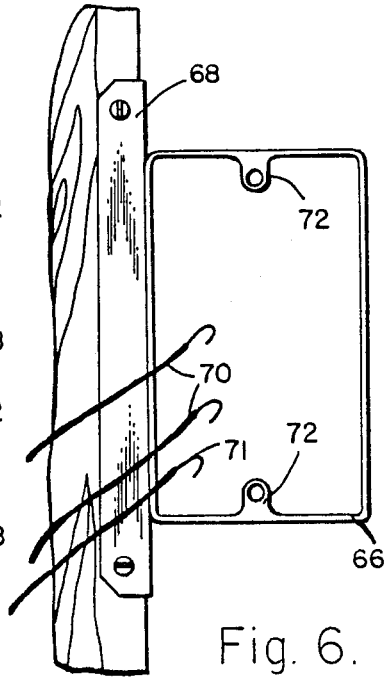
Fig. 6. PRIOR ART
FIG. 6 is a front view of a standard double plug receptacle box without the double plug receptacle.

Referring now to FIG. 6 there is illustrated a standard receptacle box 66 attached to studs 68. Located within the box 68 are house wire 70 and ground wire 71 usually provided by the builder. The box 66 contains screw holes 72 located at the upper and lower parts of the box for securing electrical components located within the box.

Figure 7:
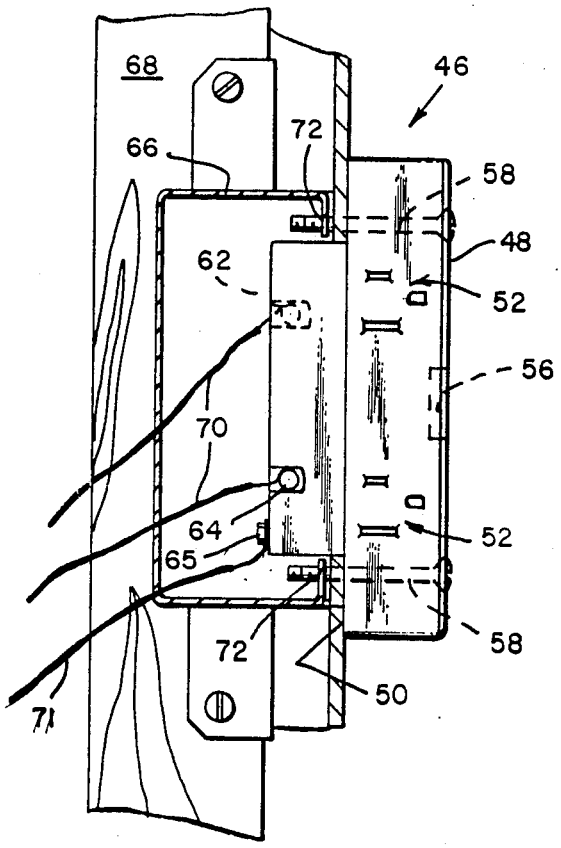
FIG. 7 is a cross section to the second embodiment of this invention inserted in a standard double plug receptacle box and FIG. 8 is a schematic diagram of the circuit including the circuit breaker included in both the first and second embodiment.

Referring now to FIG. 7 there is shown a partial cross sectional view of the receptacle box 66 with the connector 46 inserted and locked in place.

Screws 58 lock the connector 46 within the box by engaging the holes 72 located on the box. The terminal block 60 attached to the rear surface 50 is inserted within the box 66 and the wires 70 and 71 are attached to the terminals 62, 64 and 65 respectively and box 66 and the wires 70 are attached to the terminals 62 and 64 respectively. The receptacles 52 located on the periphery 54 of the connector 46 are available to the user and each receptacle is protected by the built-in circuit breaker.

Referring now to FIG. 8 there is shown a schematic diagram illustrating the electrical connection between the six receptacles 80 and the built-in circuit breaker 82. Attached to the circuit breaker 82 is a switch 84 extending through the front surface of connector 10 and the front surface of connector 46 for resetting the circuit breaker 82 if necessary.

I claim:

1. A safety electrical wall plug connector adapted to replace a conventional duplex wall receptacle and of the type having a built in circuit breaker protection device, comprising:

a sealed box having a substantially flat front surface and rear surface and a plurality of electrical receptacles having three sockets each on the periphery of said box separating said front and rear surfaces, said front containing a circuit breaker reset button adapted to control the built-in circuit breaker, three terminals located on said rear surface adapted to be directly electromechanically connected to external house wiring, said rear surface of said connector adapted to fit within an empty standard double outlet box of the type attached to building studs and containing house wiring, and a pair of screws extending through said front surface and said rear surface and adapted to engage screw openings located in said empty outlet box.

2. A safety electrical wall plug connector according to claim 1 having six of said three socket receptacles located on the periphery of the connector with one socket of each said receptacle being a ground socket and in which said ground socket is located closest said front surface.

3. A safety electrical wall plug connector according to claim 1 in which said pair of screws are adapted to securely hold the connector to the empty outlet box attached to the building studs.

4. A safety electrical wall plug connector according to claim 1 in which said circuit breaker reset button is centrally located on said front surface.

* * * * *